US006019097A

United States Patent [19]

Cox et al.

[11] Patent Number: 6,019,097

[45] Date of Patent: Feb. 1, 2000

[54] DE-TENSIONING AND BREAKDOWN SYSTEM FOR A COMPOUND BOW

[76] Inventors: Jimmie D. Cox, 18701 Vierra Canyon Rd., Salinas, Calif. 93907; Douglas T. Bresette, 45 Rialto Dr., Watsonville, Calif. 95076

[21] Appl. No.: 09/096,859

[22] Filed: Jun. 12, 1998

[51] Int. Cl.[7] ..... F41B 5/00

[52] U.S. Cl. ..... 124/23.1; 124/25.6

[58] Field of Search ..... 124/1, 23.1, 25.6, 124/86, 88

[56] References Cited

U.S. PATENT DOCUMENTS

| | | | |
|---|---|---|---|
| 2,228,823 | 1/1941 | Helm | 124/23.1 |
| 2,514,638 | 7/1950 | Grenier | 124/23.1 |
| 3,156,230 | 11/1964 | Groves | 124/23.1 |
| 4,291,452 | 9/1981 | Whitman et al. | 124/23.1 X |
| 4,599,987 | 7/1986 | Rezmer | 124/23.1 |
| 5,125,389 | 6/1992 | Paff | 124/86 |
| 5,746,192 | 5/1998 | Gissel | 124/1 |

*Primary Examiner*—John A. Ricci

*Attorney, Agent, or Firm*—Milton Wolson

[57] ABSTRACT

A foldable archery bow has a center section and two flexible arms extending in substantially opposite directions, describing a bow plane, and a separation interface disposed in the center section and positioned to allow the bow to be separated into to separate sections. At least one latching connector is attached to a first point on one of the flexible arms, and is adapted, when the flexible arm to which it is attached is substantially flexed, to latch at a second point on the same side of the separation interface as the first point. By drawing the bow, which flexes the flexible arms, and latching the latching connector, all tension is released from the bow string or strings, and all forces thereby removed from the separation interface. The separation interface, normally fastened in a closed position, may then be unfastened and separated, allowing the bow to divide into the two separate sections forming a smaller package than in the assembled aspect. The bow may be again set up by aligning and refastening the separation interface, drawing the bow, and unlatching the connector, restoring the same tension to the bow that it had before folding. In some embodiments a hinge is employed at the separation interface, allowing the bow to fold, and a variety of force removal mechanisms are taught.

12 Claims, 5 Drawing Sheets

DE-TENSIONING AND BREAKDOWN SYSTEM FOR A COMPOUND BOW

FIELD OF THE INVENTION

The present invention is in the field of archery and has particular application to methods and apparatus for de-tensioning and breaking down a compound bow for such as storage and travel.

BACKGROUND OF THE INVENTION

Bow-hunting and archery target shooting are human occupations with a long history. Accordingly the technical form of bows and other archery equipment has gone through countless design and functional improvements over time from ancient age to the present day. There are many differing designs for bows. For example, single-piece long bows, typically as tall or taller than the shooter were used by Native Americans for hunting.

Later in history, laminated bows and cross-bows (a bow mounted on a triggered gun stock) were introduced, and opposing-curve bows were developed providing more power than their predecessors. Bow strength was greatly increased via lamination techniques and the opposing curve design, termed in the art a recurve design. This landmark improvement allowed the length of the bow to decrease while retaining maximum power or pull.

More recently, an innovation known as the compound bow revolutionized the institution of archery, particularly bow hunting. The compound bow is typically a tri-sectioned (two arms and a center section) bow combined with a pulley and cabling system. Designed in important instances for hunting, the compound bow is more powerful than a traditional recurve bow but demands less stamina and strength from the user. Once the bowstring of a compound bow is drawn back to a prescribed distance, bow tension is significantly reduced allowing the shooter to relax before letting the arrow fly to target. This is accomplished via action of the pulley/cable system which acts to compound the power of the bow while at the same time reducing the pull strength required to let loose an arrow. The compound bow is arguably the most popular type of bow in use today.

One problem with a compound bow, however, is that it must be tuned or balanced before accurate shooting can be performed. That is, the tension on the upper arm of the bow must equal the tension on the lower arm of the bow in order for an arrow to fly accurately. To insure that proper balancing of tension is accomplished, one must shoot an arrow to see if it is on target. Tension adjusting devices are employed to equalize tension after the bow is strung. Adjustment and sighting-in is typically necessary each time a bow is unstrung and then strung again. These adjustments can be time-consuming especially for a novice.

Another problem stems from the fact that it is desired to be able to transport a bow and related accessories conveniently and compactly when the bow is not in use. Often, the size of a compound bow inconveniences the user in this regard. The bow is generally of an awkward shape, taking up significant space in transport. Some bow manufacturers have attempted to alleviate this problem by developing a hinged bow that may be folded over when not in use. However, the bow must first be unstrung, or the tension on the bow somehow released before the bow may be folded, because the tensioned bow imposes significant forces on the hinge in the bow stock, and once set up again, the bow must also be re-tensioned (compound bow) and re-sighted before it will shoot with accuracy.

What is clearly needed is a de-tensioning and breakdown system that will allow a compound bow to be broken-down to smaller components or sections and stowed without requiring re-tensioning, re-tuning, and re-aiming of the bow to restore the bow to its previous operational state.

SUMMARY OF THE INVENTION

In a preferred embodiment of the present invention a break-down bow is provided, comprising a center section; a first flexible arm extending from the center section in a first direction; a second flexible arm extending from the center section in a direction substantially opposite the first direction, the first and second flexible arms and the center section substantially describing a bow plane; a separation interface in the center section having a fastening mechanism adapted as fastened to retain the bow in a usable aspect, and as unfastened to allow the bow to separate at the separation interface into the two separate sections; and a first connector mechanism adapted to connect between a first point on or attached to the first flexible arm away from the center section and to a second point on the same side of the separation interface as the first point, and adapted to be selectively engaged by a user with the first flexible arm sufficiently flexed to remove all forces from the separation interface in the center section, the first connector mechanism, engaged, then retaining the first flexible arm in the flexed position such that the separation interface may be released and the bow folded.

In one embodiment the first point and the second point are both on or attached to the first flexible arm. In another the first point is on or attached to the first flexible arm, and the second point is on the center section. In preferred embodiments the first connector mechanism is a first link pivoted at the first point and adapted to latch at the second point with the first flexible arm flexed to a sufficient degree to release all force on the separation interface in the center section. The latching may be by a male-and-female latching mechanism provided at the second point. In some cases the link is pivoted by a quick-release pivot mechanism wherein, with the link unlatched, the link may be removed from the bow entirely by disengaging the quick-release pivot mechanism.

In an alternative embodiment the first connector mechanism is adapted to be engaged with the first flexible arm flexed sufficiently to remove a first portion of forces imposed on the separation interface, and there is a second connector mechanism adapted to connect between a third point on or attached to the second flexible arm away from the center section and to a fourth point on the same side of the separation interface as the third point, and adapted to be selectively engaged by a user with the second flexible arm partly flexed to remove a second portion forces imposed on the separation interface, such that the first portion of forces and the second portion of forces together equal at least the magnitude of forces on the separation interface, the first and second connector mechanisms, engaged, then retaining the flexible arms in flexed positions such that the separation interface may be released and the bow separated into the two separate sections.

In one manifestation of this alternative the first point and the second point are both on or attached to the first flexible arm, and the third point and the fourth point are both on or attached to the second flexible arm. In another the first point is on or attached to the first flexible arm, the second point is on the center section on the same side of the separation interface as the first point, the third point is on or attached to the second flexible arm, and the fourth point is on the center section on the same side of the separation interface as the third point.

The bow with two connector links is set up to provide a portion of tension release by one mechanism and another portion by the other mechanism. The links may latch by male-female latching devices. Also in preferred embodiments, whether one link or more is used, the links may be removed when not in use, if desired, by virtue of quick-release pivot points. In yet another preferred embodiment the separation interface incorporates a hinge, whereby the two separate sections may remain connected when the bow is broken down, and be folded over around the hinge.

In addition to unique apparatus to provide the objects of the invention, methods for practicing the invention are taught as well. The invention is particularly adapted and suited to compound bows, the favorite of most bow hunters, and provides, for the first time, a way to break down such a bow for travel and storage, and to set up the bow again to its exact former tension without having to readjust or resight the bow.

BRIEF DESCRIPTION OF THE DRAWING FIGURES

DESCRIPTION OF THE PREFERRED EMBODIMENTS

Figure 1:
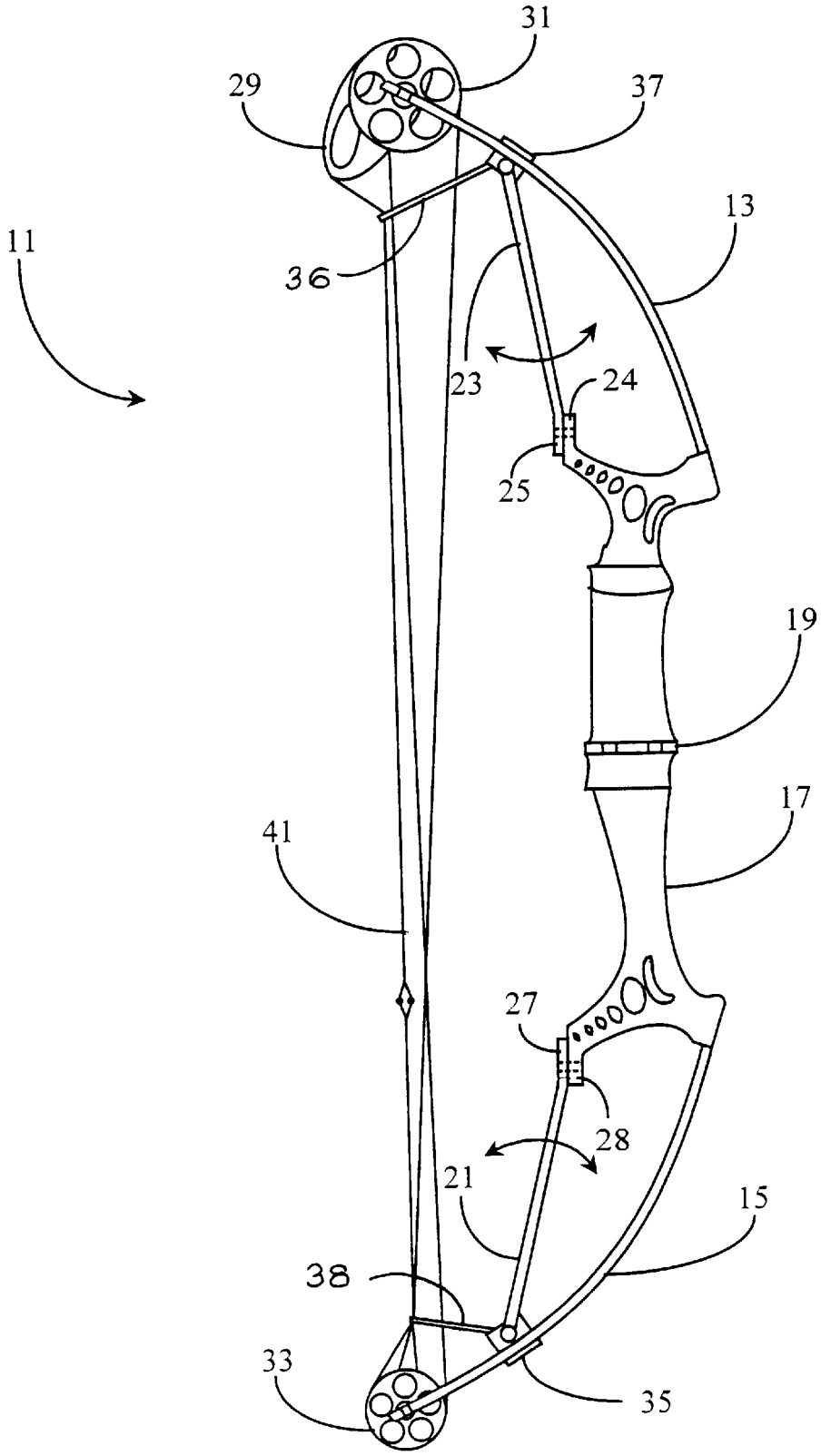
FIG. 1 is a side view of a compound bow equipped with bowstring de-tensioning and bow breakdown apparatus according to an embodiment of the present invention.

FIG. 1 is a side elevation view of a compound bow equipped with tension cancellation and bow-breakdown apparatus according to an embodiment of the present invention. A compound bow 11 is provided according to an embodiment of the present invention, which allows a bowstring 41 of bow 11 to be de-tensioned so that bow 11 may then be folded over and stowed for easy porting. A principle object of the present invention is to provide for quick breakdown and re-assembly of bow 11 after such bowstring de-tensioning and bow breakdown without requiring re-adjustment and re-aiming.

Bow 11 may be any compound-style bow, but it is emphasized that the system of the invention in other embodiments is also useful for bows of all sorts. In the case of compound bows there are typically three basic sections. A solid center section 17 acts as a support for flexible bow arms 13, and 15, and for mounting other elements, such as aiming apparatus. The flexible arms provide the string tension and the power for the bow. Center section 17 may be manufactured from aluminum, wood, or from any of several other materials common to bow manufacture. Bow arms 13 and 15 may be made from wood or from any of several polymer materials, or from other materials such as carbon fiber. Bow arms 13 and 15 are, in this embodiment, fixedly attached to center section 17. However, they may also be mounted using other means such as pivotal lock-mounting, bolting, or other methods that may be convenient for a particular style or model of a bow.

Center section 17 in a preferred embodiment has a separation interface, such as a hinge, that allows bow 11 to be separated into two sections. In the embodiment used herein, the separation interface is hinged, so the two sections of the bow remain connected, although the bow, when broken down, becomes folded in a direction substantially perpendicular from the flat plane of bow 11, which may be considered to be the plane of the paper in FIG. 1. In this embodiment, hinge 19 is substantially centered longitudinally on center section 17, although the exact position of the hinge or other separation interface is not critical. The direction of fold may be either direction, and, depending on the mounting of peripheral apparatus in particular bows, one direction may be preferable over the other.

Hinge 19 or a separation interface without a hinge may be secured (locked) via any of several known methods. In this embodiment, hinge 19 or other interface is secured by screw fasteners when bow 11 is in use. In another embodiment, the interface may be clamped, or perhaps locked with a quick-release-type locking mechanism.

In the case of a compound bow, pulley mechanisms such as pulleys 29 and 31 pivotally attached to upper bow-arm 13, and pulley 33 pivotally shown attached to lower bow-arm 15, are for providing mechanical advantage in a compound bow. Other sorts of bows to which the invention may be applied do not have these mechanisms. In any case, such mechanisms are well-known in the art, and not critical to the invention. Other mechanisms not shown but common to compound bows as accessories or attachments may be assumed to be present such as bow tension adjustment devices, arrow rests, aiming sights, and so on. The method and apparatus of the present invention may be applied to substantially any sort of compound bow.

Referring again to FIG. 1, and assuming bow 11 to be set up, aimed in, and ready for use, to break down the bow it is necessary to remove the forces imposed on the hinge as a result of the tension in the string and pulley apparatus. To accomplish releasing the tension there are two unique latching links, link 21 and link 23, that act, when engaged, to hold arms 13 and 15 in a flexed position independent of one another, removing tension on the string and pulley apparatus, and therefore also on center section 17 and its hinge. Links 21 and 23 are pivotally attatched to bow arms 13 and 15 such that each may rotate substantially in the flat plane of the bow. A mounting clamp 37 is provided and mounted to bow arm 13 in order to support pivotal mounting apparatus for link 23. A similar mounting clamp 35 is similarly provided and mounted to bow arm 15 in order to affect the same purpose relative to link 21.

Link 23, pivoted at one end, has a latching mechanism at the opposite end 25 adapted to latch to an appropriate apparatus on center section 17, when arm 13 is partially and substantially flexed. Similarly, link 21 has a free end 27 with the same mechanism and serving the same purpose for flexible arm 15. Links 23 and 21 in a preferred embodiment are removable after use and may be detached from their pivotal positions at clamps 37 and 35 via quick-release pivot mounts (not shown in FIG. 1). Such quick-release pivot mounts are known in the art and are described in more detail below.

Figure 2:
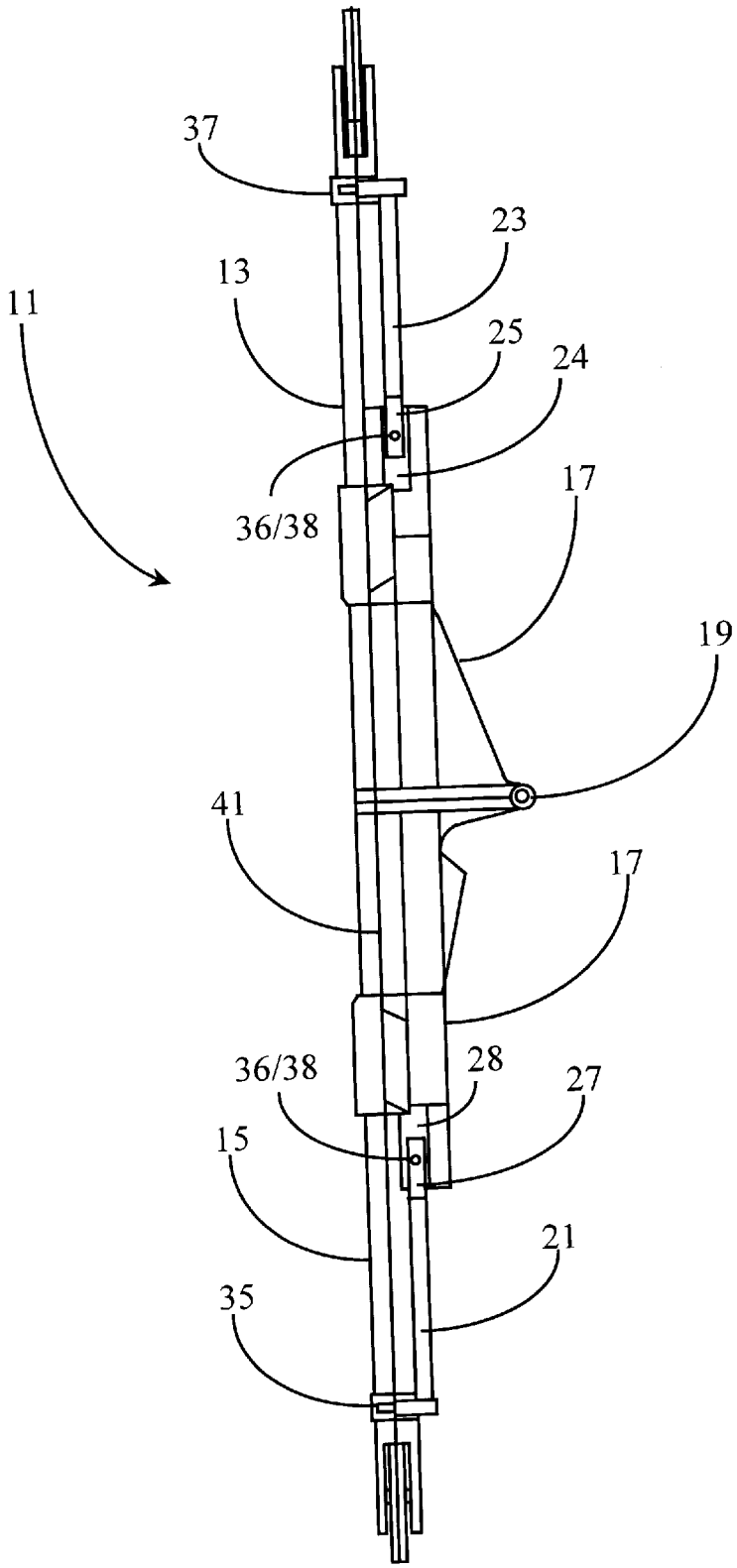
FIG. 2 is a rear view of the compound bow of FIG. 1.

FIG. 2 is a rear view of the compound bow of FIG. 1. Ends 25 and 27 in this embodiment each have a hole 36 adapted to engage a pin 38 at each one of two contact locations 24 and 28 on center section 17. The length of each of links 21 and 23 from the pivot to the circular opening at the opposite end is such that the pin and opening will not line up to engage unless the bow is sufficiently drawn, resulting in sufficient bending of the flexible arms of the bow. The position of the latching mechanism is such that if latched in the bow's drawn position, all tension on the stings and separation interface, in this case a hinge, will be released. One sets the latches by aiming the bow downward and drawing the bow until the pins on center-section 17 engage the holes in the links. The links in this bow position naturally pivot downward, so when the pins and holes align, they engage. When one then releases the bow, each of the flexible arms 13 and 15 remain independently flexed, and tension is removed from hinge 19. Rubber bands 36 and 38 may be utilized to secure bowstring 41 in place around the respective pulleys 29, 31, and 33.

When one sets up a bow, the links may be released by pointing the bow upward and drawing the bow. Gravity in this position causes the links to rotate away from center section 17, and the pins and holes disengage when the bow is sufficiently drawn.

The skilled artisan will be aware that pins and holes are but one of several latching arrangements that might be made. In another embodiment, for example, a hook instead of a pin may be provided on center section 17 with the hook adapted to catching a horizontally mounted pin on a pivotal link. Other types of groove and catch mechanisms may be used as well. One with ordinary skill will recognize that a number of known male-female mechanisms will suffice for the purpose.

Figure 3:
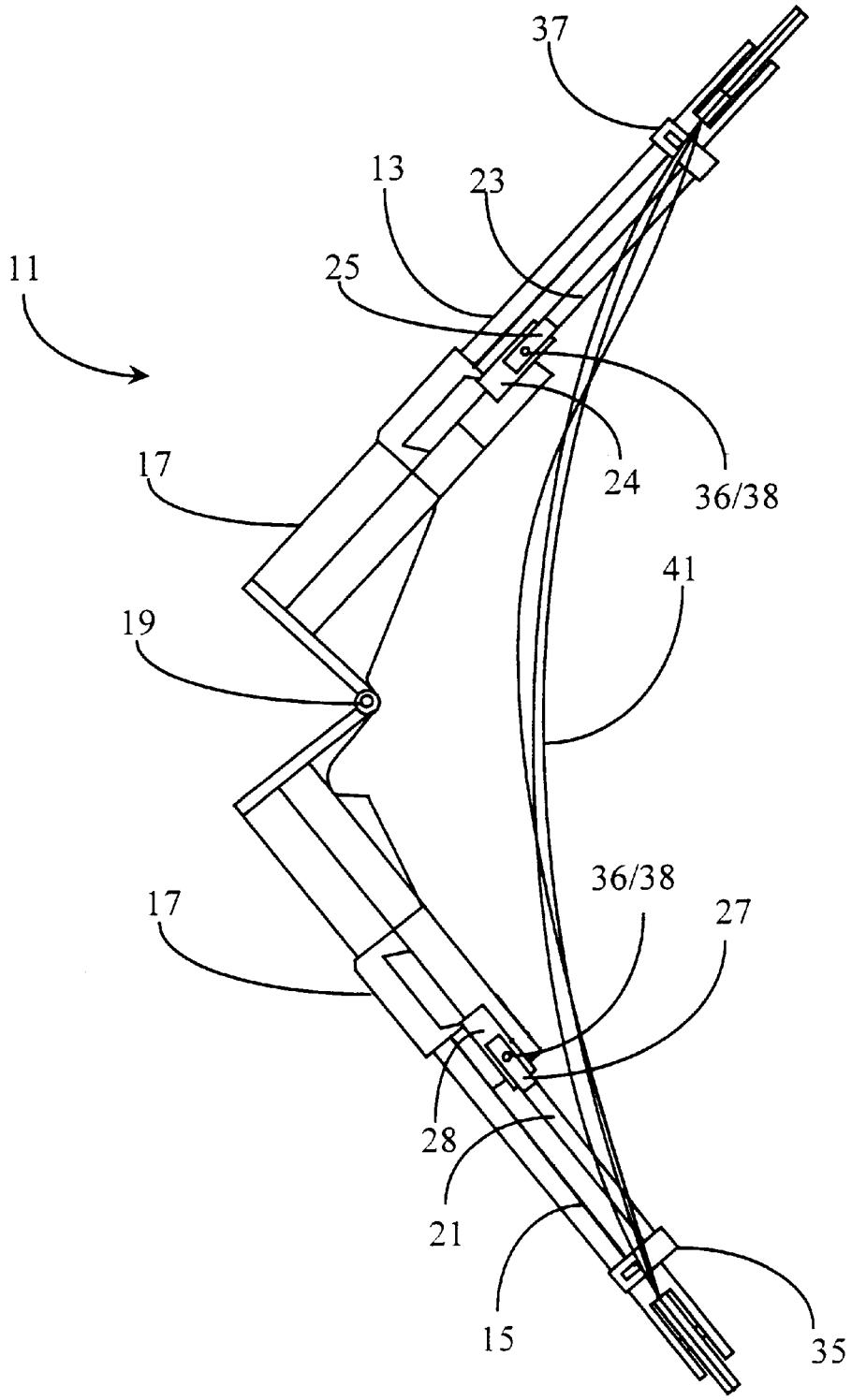
FIG. 3 is a rear view of the compound bow of FIG. 1 shown with the bowstring de-tensioned and the bow partly folded according to an embodiment of the present invention.

FIG. 3 is a rear view of the compound bow of FIG. 1 shown with the bowstring de-tensioned by latching the links with the flexible arms partially flexed, and with the bow partly folded over the hinge.

Hinge 19 is held closed in a preferred embodiment by conventional fasteners such as socket-head screws, as is described further below with aid of FIG. 5. A separation interface without a hinge in an alternative embodiment is held closed in the same manner. In the break-down operation the user de-tensions the bow as described above, then unbolts the hinge and folds the bow around the hinge. Once folded the bow may be conveniently carried as a smaller, less clumsy package, or may be placed in a special carrying case designed to accommodate the folded bow.

To re-assemble bow 11 for operation, a user simply closes hinge 19 and bolts it closed, thereby returning bow 11 to it's original upright position. Once this is accomplished and hinge 19 is secure, a user points bow 11 skyward, as briefly described above, while drawing back bowstring 41 with sufficient force required to release links 21 and 23 from their latched condition. Links 23 and 21 may then swing about their pivot mounts toward the user. Bowstring 41 is then released, returning the bow to its ready-to-shoot condition and links 23 and 21 may be detached from their pivotal mounts and stowed. Bow 11 is then ready to use. It is important to note, as well, that the bow is restored in a single swift motion to exactly the tension that it had when de-tensioned for folding, and therefore no adjustment or re-aiming is needed.

In an alternate embodiment, links 23 and 21 may be adapted to swing in a plane perpendicular from the plane of the bow. In that case the position of holding the bow to latch or de-latch catch-ends 25 and 27 would be changed according to the alternate direction of swing. For example, holding the bow horizontally while drawing the bowstring for enabling the latches, and then flipping the bow over in the same position for releasing the latches. While this embodiment is possible, it is preferred that links 23 and 21 swing in the plane of the bow as previously described above.

In an alternate embodiment, the method and apparatus of the present invention may be practiced on a conventional re-curve style bow simply as a means to de-tension the bowstring for easy replacement as previously described.

Figure 4:
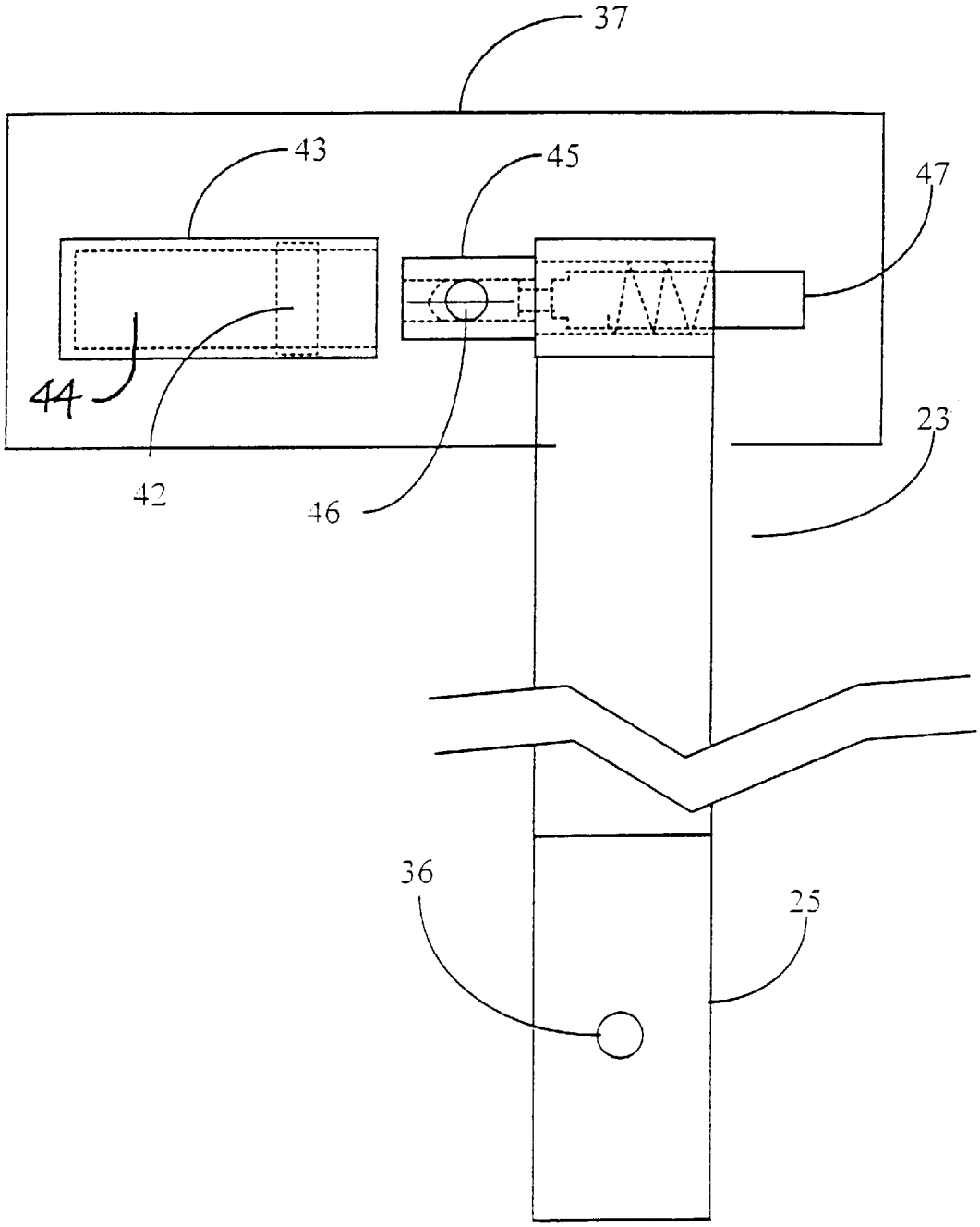
FIG. 4 is an expanded view of a latching link and pivot components according to an embodiment of the present invention.

FIG. 4 is an enlarged view of link and pivot components according to an embodiment of the present invention. A suitable quick-release method for pivotal mounting of latching links to bow arms is provided and is also well known in the art. Mount 37 is shown mounted on upper bow arm 13 of FIG. 1. Returning to FIG. 4, a quick-release socket 43 comprises a circular bore 44 and a groove 42 radially around the inside diameter of the circular bore. A quick-release shaft 45 has an outside diameter smaller than the inside diameter of bore 44 and a spring-loaded ball 46 adapted to engage groove 42. A quick-release pin 47 is adapted to release the pin-and-groove engagement to release a pivot for removal.

Figure 5:
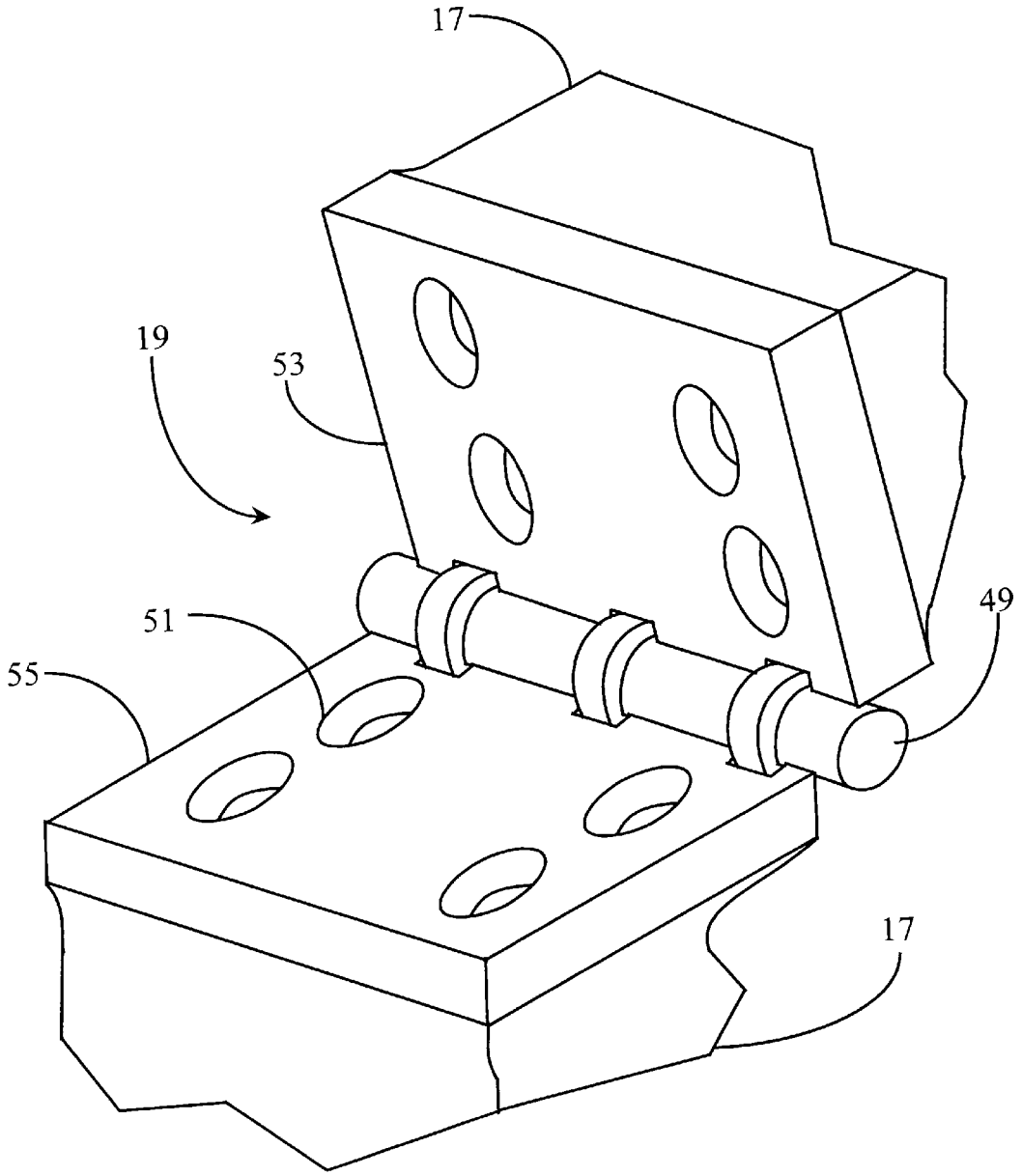
FIG. 5 is an enlarged view of a bow hinge of the bow of FIGS. 1–3.

FIG. 5 is an enlarged view of bow hinge 19 of FIG. 3. Hinge 19 is a typical pinned-hinge comprising a hardened steel pin 49 and hinge-plates 53, and 55. Both hinge plates 53 and 55 contain bolt holes 51 placed to facilitate bolting hinge 19 to a closed position. Bolt holes 51 are accessible via cut away areas (not shown) in center section 17 from the pin-side of hinge 19 both above and below hinge 19. In an alternative embodiment a hinge is not used, but the joining plates with matching holes may be as seen in FIG. 5.

There are a variety of ways to present hinge 19 without departing from the spirit and scope of the present invention. For example, center section 17 (actually two separate pieces) may be bolted on to hinge plates 53 and 55. In another embodiment, center section 17 may be provided with hinge elements l9 incorporated into the construction such that each side of hinge 19 is of the same material and of one piece with each section-half to be hinged. In this case bolting may be accomplished in the same fashion.

It will be apparent to one with skill in the art that various styles of compound bows will have center sections of differing constructions and shapes. Therefore, the exact configuration of hinge 19, in those embodiments having a hinge, and bolting arrangement may vary accordingly.

It will also be apparent to the skilled artisan, after reading the present teaching, that it is not necessary to flex and latch both flexible arms of a compound bow to remove all forces imposed by the bow on a hinge in the center section. A single link acting to latch either one of the flexible arms flexed to a suitable degree will suffice to remove forces from the hinge and allow the bow to fold. Accordingly, in some alternative embodiments only one such link is provided. It will be apparent, too, that the latching mechanism can also attach to two divergent points on the same flexible arm. It will also be apparent that swinging and latching links are not the only apparatus that may be used to accomplish the purpose. One might connect a position away from the center section on a flexible arm of such a bow with the center section by any of several devices, such as a cable arrangement with a turnbuckle, a fold-over latch with cable ends as are known in the art, and by other ways as well. It is desirable that the mechanism used allow quick and simple, as well as safe operation.

It will also be apparent to one with skill in the art that hinge 19 may be provided with a locking means other than conventional fasteners without departing from the spirit and scope of the present invention. For example, in one embodiment, a u-shaped sliding lock piece may be adapted to engage slots in hinge-plates 53 and 55 thus locking them closed. In another embodiment, external clamps may replace bolts, and so on. In embodiments without a hinge there are similar variations in the manner in which the opposing parts of the separation interface may be fastened.

Two desirable attributes for hinge 19 are that opening occurs in a direction substantially perpendicular to the plane of the bow, and that sufficient locking force is used when locking hinge 19 in a closed position.

It will be apparent to one with skill in the art that the apparatus of the invention comprising links, pivot mounts and the like, including a hinge such as hinge 19, may be manufactured into a new compound bow, or into an existing compound bow to be modified. It will also be apparent, as described above, that a wide variety of separation interfaces may be used without a hinge. The method and apparatus of the present invention is limited only by the claims that follow.

What is claimed is:

1. A break-down bow, comprising:

a center section;

a first flexible arm extending from the center section in a first direction;

a second flexible arm extending from the center section in a direction substantially opposite the first direction, the first and second flexible arms and the center section substantially describing a bow plane;

a separation interface in the center section having a fastening mechanism adapted as fastened to retain the bow in an assembled and usable aspect, and as unfastened to allow the bow to separate into two separate sections at the separation interface; and a first connector mechanism adapted to connect between a first position on or attached to the first flexible arm away from the center section and at a second position on the same side of the separation interface as the first position, and adapted to be selectively engaged by a user with the first flexible arm sufficiently flexed to remove all forces from the separation interface in the center section, the first connector mechanism, engaged, then retaining the first flexible arm in the flexed position such that the separation interface may be released and the bow separated into the two separate sections.

2. The bow of claim 1 wherein the first position is on or attached to the first flexible arm, and the second position is on the center section.

3. The bow of claim 1 wherein the first connector mechanism is a first link pivoted at the first position and adapted to latch at the second position with the first flexible arm flexed to a sufficient degree to release all force on the separation interface in the center section.

4. The bow of claim 3 wherein the first link is adapted to latch by a male-and-female latching mechanism provided at the second position.

5. The bow of claim 4 wherein the link is pivoted by a quick-release pivot mechanism wherein, with the link unlatched, the link may be removed from the bow entirely by disengaging the quick-release pivot mechanism.

6. The bow of claim 1 wherein the first connector mechanism is adapted to be engaged with the first flexible arm flexed sufficiently to remove a first portion of forces imposed on the separation interface, and further comprising a second connector mechanism adapted to connect between a third position on or attached to the second flexible arm away from the center section and at a fourth position on the same side of the separation interface as the third position, and adapted to be selectively engaged by a user with the second flexible arm partly flexed to remove a second portion of forces imposed on the separation interface, such that the first portion of forces and the second portion of forces together equal at least the magnitude of forces on the separation interface, the first and second connector mechanisms, engaged, then retaining the flexible arms in flexed positions such that the separation interface may be released and the bow separated into the two separate sections.

7. The bow of claim 6 wherein the first position is on or attached to the first flexible arm, the second position is on the center section on the same side of the separation interface as the first position, the third position is on or attached to the second flexible arm, and the fourth position is on the center section on the same side of the separation interface as the third position.

8. The bow of claim 6 wherein the first connector mechanism is a first link pivoted at the first position and adapted to latch at the second position with the first flexible arm flexed to a sufficient degree to release the first portion of forces on the separation interface in the center section, and the second connector mechanism is a second link pivoted at the third position and adapted to latch at the fourth position to remove the second portion of forces on the separation interface in the center section.

9. The bow of claim 8 wherein both links are adapted to latch by a male-and-female latching mechanism provided at the second position and at the fourth position.

10. The bow of claim 9 wherein the links are each pivoted by a quick-release pivot mechanism wherein, with one of the links unlatched, the unlatched link may be removed from the bow entirely by disengaging the quick-release pivot mechanism.

11. The bow of claim 1 wherein the separation interface further comprises a hinge, whereby with the separation interface separated, the two portions of the bow remain connected and may be folded about the hinge.

12. A method for breaking down an archery bow into two sections, the bow comprising a center section with upper and lower flexible arms attached and describing a bow plane, comprising steps of:

(a) positioning a separation interface in the center section of the bow, the separation interface positioned to allow the bow to separate into two sections;

(b) drawing the bow such that upper and lower flexible arms of the bow are flexed;

(c) latching at least one connector link between a first position on one of the flexible arms, and a second position on the same side of the separation interface as the first position, such that all force imposed by the flexible arms is removed from the separation interface; and (d) separating the bow at the separation interface.

* * * * *